US007576713B2

(12) United States Patent
Han et al.

(10) Patent No.: US 7,576,713 B2
(45) Date of Patent: Aug. 18, 2009

(54) PLASMA DISPLAY APPARATUS

(75) Inventors: Jung Gwan Han, Gumi-si (KR); Kirack Park, Gyeongsangbuk-do (KR); Jongwoon Bae, Gumi-si (KR); Seonghwan Ryu, Gumi-si (KR)

(73) Assignee: LG Electronics Inc., Seoul (KR)

( * ) Notice: Subject to any disclaimer, the term of this patent is extended or adjusted under 35 U.S.C. 154(b) by 617 days.

(21) Appl. No.: 11/380,164

(22) Filed: Apr. 25, 2006

(65) Prior Publication Data

US 2007/0247397 A1 Oct. 25, 2007

(51) Int. Cl.
*G09G 3/28* (2006.01)
*G09G 3/285* (2006.01)

(52) U.S. Cl. ..... 345/60; 345/67

(58) Field of Classification Search ..... 345/60, 345/67

See application file for complete search history.

(56) References Cited

FOREIGN PATENT DOCUMENTS

| | | |
|---|---|---|
| CN | 1677462 | 10/2005 |
| EP | 0 307 231 | 3/1989 |
| EP | 0 307 231 A2 | 3/1989 |
| EP | 1 585 092 | 10/2005 |
| EP | 1 585 096 | 10/2005 |

OTHER PUBLICATIONS

Office Action issued by the European Patent Office on Nov. 9, 2006 for Application No. 06007803.8 - 2205. (9 pages).

*Primary Examiner*—Evan Pert
(74) *Attorney, Agent, or Firm*—Fish & Richardson P.C.

(57) ABSTRACT

A plasma display apparatus is provided. The plasma display apparatus includes a data drive IC for supplying a data signal corresponding to an image signal to the address electrode through an output terminal formed at one side and the other side of the data driver IC, which oppose to each other, during the supply of the scan signal to an electrode of the plasma display panel.

20 Claims, 10 Drawing Sheets

PLASMA DISPLAY APPARATUS

BACKGROUND OF THE INVENTION

1. Field of the Invention

This document relates to a plasma display apparatus.

2. Description of the Background Art z A plasma display apparatus comprises a plasma display panel for displaying an image and a driver for driving the plasma display panel.

FIG. 1 illustrates a structure of a plasma display panel. As shown in FIG. 1, the plasma display panel comprises a front panel 10 and a rear panel 11. The front panel 10 comprises a front glass substrate 100 and the rear panel 11 comprises a rear glass substrate 110.

A scan electrode 101 and a sustain electrode 102 for maintaining emissions of cells through a mutual discharge therebetween are formed on the front glass substrate 100. The scan electrode 101 and the sustain electrode 102 each comprise transparent electrodes 101*a* and 102*a* made of a transparent indium-tin-oxide (ITO) material, and bus electrodes 101*b* and 102*b* made of a metal material. A scan signal for scan of the plasma display panel and a sustain signal for discharge maintenance of the plasma display panel are supplied to the scan electrode 101. A maintenance signal is mainly supplied to the sustain electrode 102. An upper dielectric layer 103 is formed on upper parts of the scan electrode 101 and the sustain electrode 102 to limit a discharge current and to provide insulation between the scan electrode 101 and the sustain electrode 102. A protective layer 104 with a deposit of MgO is formed on an upper surface of the upper dielectric layer 103 to facilitate discharge conditions.

Address electrodes 112 are formed on the rear glass substrate 110 to intersect the scan electrode 101 and the sustain electrode 102. A lower dielectric layer 114 is formed on an upper part of the address electrode 112 to provide insulation between the address electrodes 113. Barrier ribs 111 are formed on the lower dielectric layer 114 to form discharge cells. A phosphor layer 113 is coated between the barrier ribs 111 to emit visible light.

A plasma display apparatus comprises a data driver for driving the address electrode 112. The data driver supply a data signal corresponding to an image signal to the address electrode 112. The data driver comprises a data drive integrated circuit (IC) for generating the data signal. The data drive IC is included in a film type element such as a tape carrier package (TCP) or a chip-on-film (COF).

FIG. 2 illustrates a data drive IC of a plasma display apparatus. As shown in FIG. 2, the data drive IC of the plasma display apparatus receives an image signal through an input terminal 210, and supplies a data signal corresponding to the image signal to the address electrode 112 of FIG. 1 through an output terminal 220. The input terminal 210 of the data drive IC is formed at one side of the data drive IC, and the output terminal 220 of the data drive IC is formed at the other side opposite one side of the data drive IC. A formation direction of the output terminal 220 of the data drive IC is substantially parallel to a formation direction of the address electrode 112 of FIG. 1.

As the plasma display apparatus supports full high definition (HD), the number of output terminals formed on one data drive IC increases. Since the number of output terminals increases, the length and the size of the data drive IC increase. When the size of the data drive IC increases, the size of the film-type element increases. Accordingly, the manufacturing cost of the data drive IC or the manufacturing cost of the film-type element increases, and the manufacturing cost of the plasma display apparatus increases.

In FIG. 2, a reference numeral 230 denotes a power terminal. A data voltage for forming a maximum voltage of the data signal is input to the power terminal 230. Further, a reference numeral 240 denotes a ground terminal. A ground level voltage for forming a ground level of the data signal is input to the ground terminal 240.

SUMMARY OF THE INVENTION

According to one aspect, there is provided a plasma display apparatus comprising a plasma display panel comprising an electrode, and a data drive integrated circuit (IC) for supplying a data signal corresponding to an image signal to the electrode through an output terminal formed at one side and the other side of the data drive IC which oppose to each other.

According to another aspect, there is provided a plasma display apparatus comprising a plasma display panel comprising a scan electrode, a sustain electrode and an address electrode, a scan driver for driving the scan electrode, a sustain driver for driving the sustain electrode, and a data drive IC for supplying a data signal corresponding to an image signal to the address electrode through an output terminal formed at one side and the other side of the data driver IC which oppose to each other.

According to still another aspect, there is provided a plasma display apparatus comprising a plasma display panel comprising a scan electrode, a sustain electrode and an address electrode, a scan driver for supplying a first signal, which rises to a negative direction, in a pre-reset period, after supplying a second signal which rises to a positive direction, for supplying a third signal, which rises to a negative direction, in a reset period, and for supplying a scan signal in an address period, to the scan electrode, a sustain driver for supplying a fourth signal, which rises to a positive direction, to the sustain electrode in the pre-reset period, and a data drive IC for supplying a data signal corresponding to an image signal to the address electrode through an output terminal formed at one side and the other side of the data driver IC, which oppose to each other, during the supply of the scan signal to the scan electrode.

BRIEF DESCRIPTION OF THE DRAWINGS

The embodiment of the invention will be described in detail with reference to the following drawings in which like numerals refer to like elements.

DETAILED DESCRIPTION OF PREFERRED EMBODIMENTS

Figure 1:
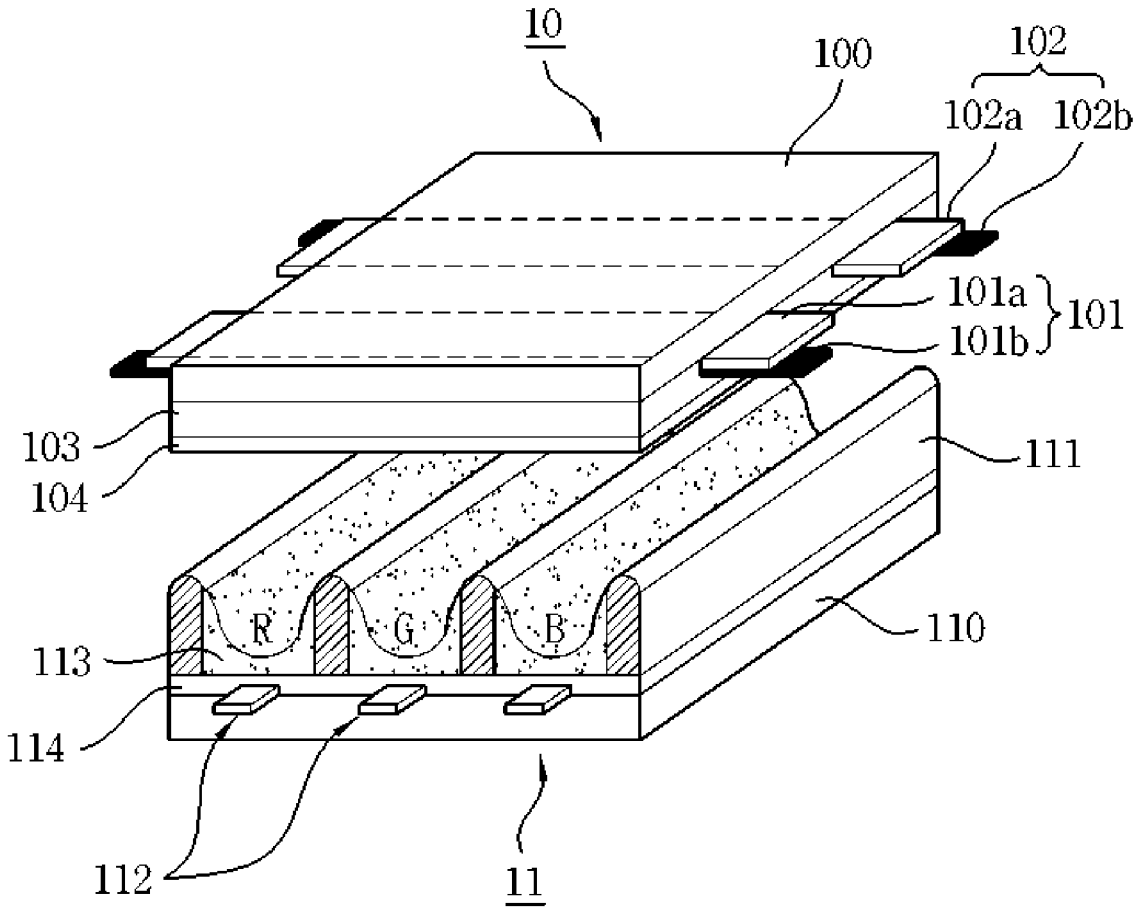
Fig. 1 Related Art
FIG. 1 illustrates a structure of a plasma display panel.

Embodiments of the present invention will be described in a more detailed manner with reference to the drawings.

A plasma display apparatus according to an embodiment of the present invention comprises a plasma display panel comprising an electrode, and a data drive integrated circuit (IC) for supplying a data signal corresponding to an image signal to the electrode through an output terminal formed at one side and the other side of the data drive IC which oppose to each other.

The electrode may comprise an address electrode.

An input terminal of the data drive IC for receiving the image signal may be formed at one side of the data drive IC.

The input terminal may be substantially formed in the center of one side of the data drive IC. A part of the output terminal formed at one side of the data drive IC may be formed at the left of the input terminal formed in the center of one side of the data drive IC. The remaining part of the output terminal formed at one side of the data drive IC may be formed at the right of the input terminal formed in the center of one side of the data drive IC.

The data drive IC may comprise an input terminal, which receives the image signal and is formed at one side of the data drive IC, a data voltage wiring unit for receiving a data voltage of the data signal, and a reference voltage wiring unit for receiving a reference voltage of the data signal.

The reference voltage wiring unit may comprise two or more ends. At least one of the two or more ends may be formed at one side of the data drive IC.

The reference voltage may be a ground level voltage.

The data drive IC may be mounted on a film type element.

A direction of an electrode terminal of the film type element may be substantially parallel to a longitudinal direction of the data drive IC.

The data drive IC may comprise a high-voltage circuit for outputting the data signal to the output terminal of the data drive IC, a logical circuit for controlling the high-voltage circuit, an auxiliary power supply unit for supplying a power source to the logical circuit, an auxiliary reference power supply unit for supplying a reference voltage to the logical circuit, a data voltage wiring unit for supplying a data voltage of the data signal to the high-voltage circuit, and a reference voltage wiring unit for supplying a reference voltage to the high-voltage circuit. The auxiliary power supply unit, the auxiliary reference power supply unit, the data voltage wiring unit, and the reference voltage wiring unit may be formed on the same layer.

The auxiliary power supply unit, the auxiliary reference power supply unit, the data voltage wiring unit, and the reference voltage wiring unit may comprise a metal layer.

A plasma display apparatus according to the embodiment of the present invention comprises a plasma display panel comprising a scan electrode, a sustain electrode and an address electrode, a scan driver for driving the scan electrode, a sustain driver for driving the sustain electrode, and a data drive IC for supplying a data signal corresponding to an image signal to the address electrode through an output terminal formed at one side and the other side of the data driver IC which oppose to each other.

A plasma display apparatus according to the embodiment of the present invention comprises a plasma display panel comprising a scan electrode, a sustain electrode and an address electrode, a scan driver for supplying a first signal, which rises to a negative direction, in a pre-reset period, after supplying a second signal which rises to a positive direction, for supplying a third signal, which rises to a negative direction, in a reset period, and for supplying a scan signal in an address period, to the scan electrode, a sustain driver for supplying a fourth signal, which rises to a positive direction, to the sustain electrode in the pre-reset period, and a data drive IC for supplying a data signal corresponding to an image signal to the address electrode through an output terminal formed at one side and the other side of the data driver IC, which oppose to each other, during the supply of the scan signal to the scan electrode.

The pre-reset period may be included in a first subfield of all of subfields.

A magnitude of a maximum voltage of a rising ramp signal supplied in the first subfield may be more than a magnitude of a maximum voltage of a rising ramp signal supplied in a subfield which follows the first subfield.

When supplying the third signal, the sustain driver may supply a reference voltage to the sustain electrode.

The output terminal of the data drive IC may supply the data signal formed by resonance to the address electrode.

Hereinafter, exemplary embodiments of the present invention will be described in detail with reference to the attached drawings.

Figure 3:
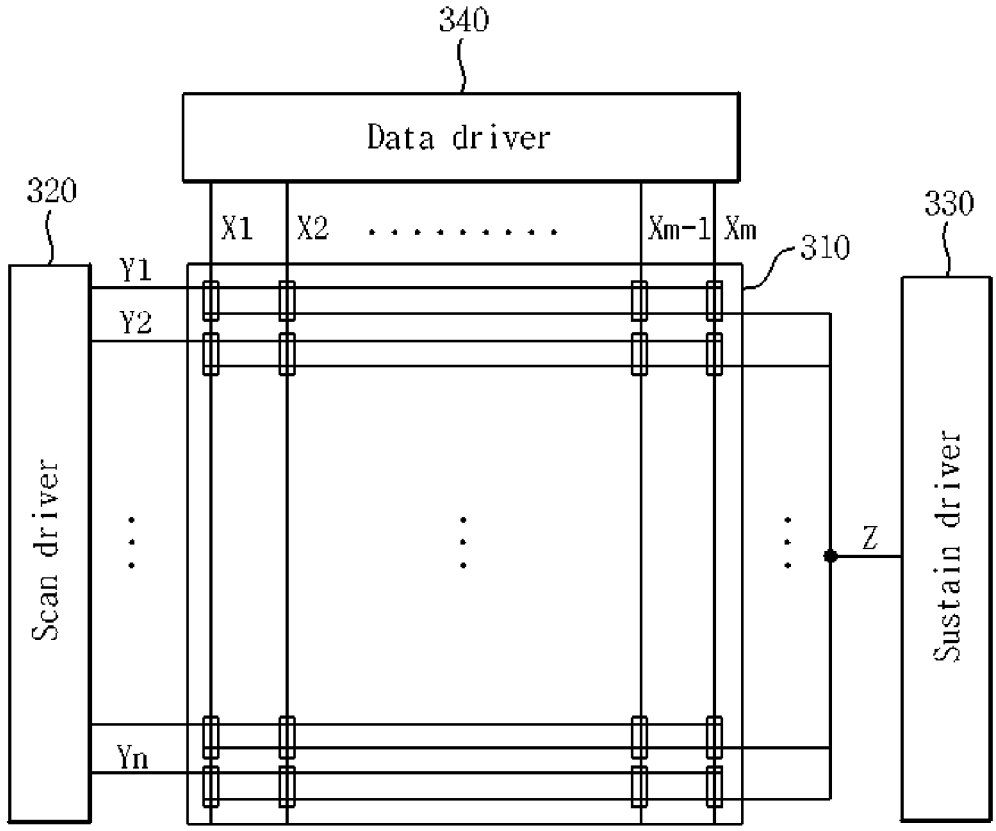
FIG. 3 illustrates a plasma display apparatus according to an embodiment of the present invention.

FIG. 3 illustrates a plasma display apparatus according to an embodiment of the present invention. As shown in FIG. 3, the plasma display apparatus according to the embodiment of the present invention comprises a plasma display panel 310, a scan driver 320, a sustain driver 330, and a data driver 340. The plasma display apparatus according to the embodiment of the present invention represents gray scale by a combination of subfields constituting a frame. In other words, one frame comprises a plurality of subfields. Each of the subfields comprises a reset period for initializing all of cells of the plasma display panel 310, an address period for selecting cells, and a sustain period for generating a maintenance discharge within the selected cells. The gray scale of the image is represented by changing gray level of the sustain period in accordance with the combination of at least one subfield of the plurality of subfields.

The plasma display panel 310 comprises scan electrodes Y1 to Yn, sustain electrodes Z, and address electrodes X1 to Xm.

The scan driver 320 supplies a reset signal for initializing all of the cells of the plasma display panel 310 during the reset period, a scan signal for selecting the cells during the address period, and a sustain signal for generating the maintenance discharge within the selected cells during the sustain period, to the scan electrodes Y1 to Yn.

The sustain driver 330 supplies a bias voltage to the sustain electrodes Z. The sustain driver 330 supplies a sustain signal for generating the maintenance discharge within the selected cells to the sustain electrodes Z during the sustain period.

The data driver 340 receives an image signal, generates a data signal synchronized with the scan signal, and supplies the data signal to the address electrodes X1 to Xm. The data driver 340 comprises a data drive IC for generating the data signal corresponding to the image signal The image signal received to the data driver 340 is obtained after performing an image processing process. In other words, a controller (not shown) of the plasma display apparatus according to the embodiment of the present invention outputs an image signal corresponding to an image processing result obtained after performing an inverse gamma correction process, an error diffusion process, a dithering process, a subfield mapping process, and a subfield rearrange process. The inverse gamma correction process improves linearity of gray scale. The error diffusion process diffuses an error generated after the performance of the inverse gamma correction process. The dithering process reflects the error to real gray. The subfield mapping process performs mapping of the real gray. The subfield rearrange process arranges gray information mapped in the subfield by the subfields.

Figure 4:
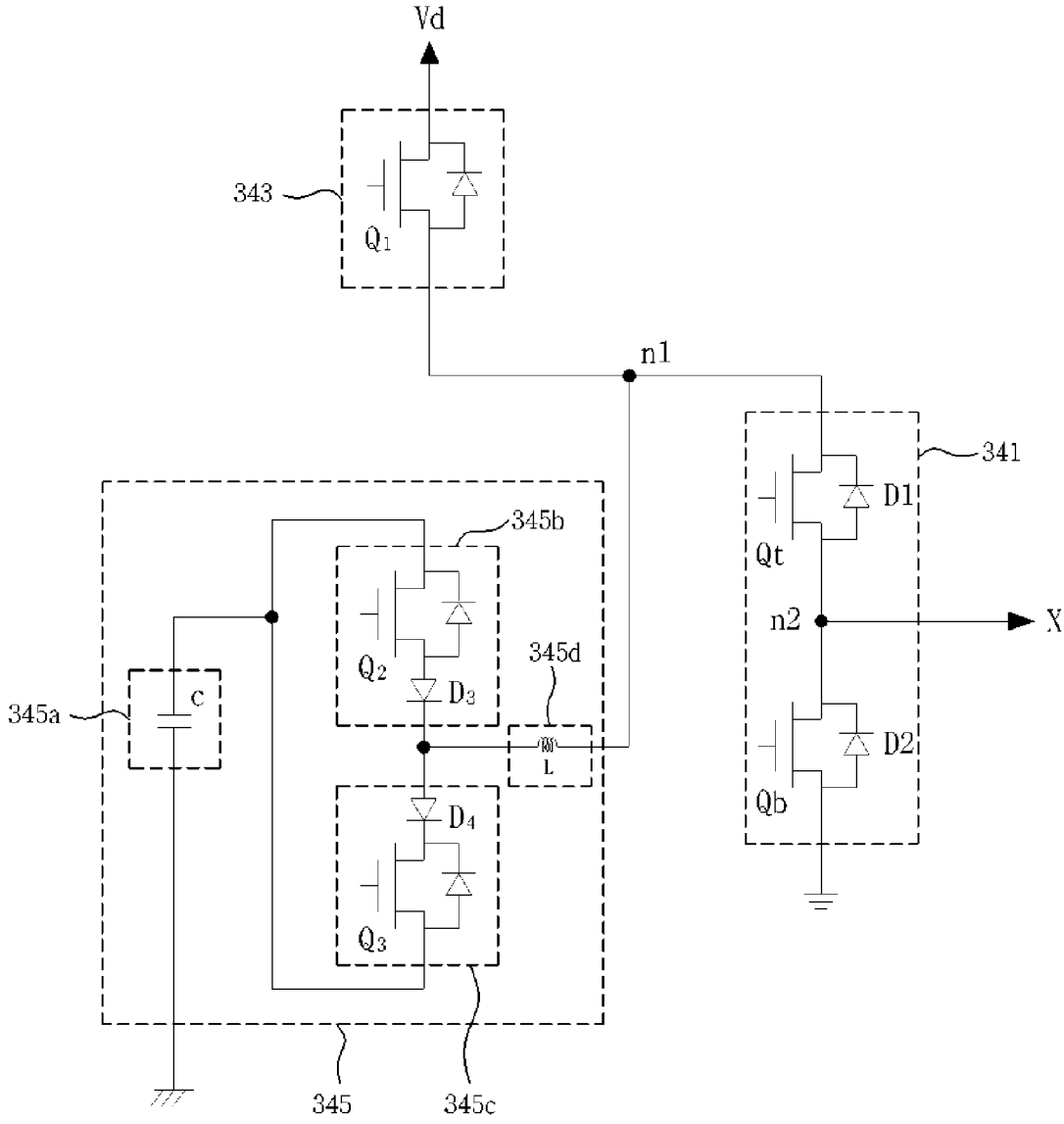
FIG. 4 illustrates a data driver of the plasma display apparatus according to the embodiment of the present invention.

FIG. 4 illustrates a data driver of the plasma display apparatus according to the embodiment of the present invention. As shown in FIG. 4, the data driver of the plasma display apparatus according to the embodiment of the present invention comprises a data drive IC 341, a data voltage supply control unit 343, and an energy recovery circuit unit 345.

The data voltage supply control unit 343 comprises a data voltage supply control switch Q1. The data voltage supply control unit 343 supplies a data voltage Vd supplied from a data voltage source (not shown) to the data drive IC 341.

The data drive IC 341 of the plasma display apparatus according to the embodiment of the present invention is connected to the address electrode X of the plasma display panel. The data drive IC 341 supplies the data signal to the address electrode X through a switching operation.

Components of the data drive IC 341, which are not shown in FIG. 4, will be described in detail with reference to the subsequent drawings. For example, the data drive IC 341 of the plasma display apparatus according to the embodiment of the present invention comprises an output terminal formed at one side and the other side of the data drive IC 341 which oppose to each other, and an input terminal formed at one side of the data drive IC 341.

The data drive IC 341 comprises a top switch Qt and a bottom switch Qb. One terminal of the top switch Qt is commonly connected to the data voltage supply control unit 343, and the energy recovery circuit unit 345. The other terminal of the top switch Qt is connected to one terminal of the bottom switch Qb. The other terminal of the bottom switch Qb is grounded. A second node n2 connected to the other terminal of the top switch Qt and one terminal of the bottom switch Qb is connected to the address electrode X.

The energy recovery circuit unit 345 comprises an energy storing unit 345*a*, an energy supply control unit 345*b*, an energy recovery control unit 345*c*, and an inductor unit 345*d*.

The energy storing unit 345*a* comprises an energy storing capacitor C. The energy storing unit 345*a* stores an energy, which will be supplied to the address electrode X of the plasma display panel, and stores an energy recovered from the plasma display panel.

The energy supply control unit 345*b* comprises an energy supply control switch Q2. The energy supply control unit 345*b* forms a supply path of the energy supplied from the energy storing capacitor C to the address electrode X. One terminal of the energy supply control unit 345*b* is connected to the energy storing capacitor C.

It is preferable that the energy supply control unit 345*b* further comprises a reverse blocking diode D3 for preventing an inverse current from flowing to the energy storing unit 345*a* through the energy supply control switch Q2.

The energy recovery control unit 345*c* comprises an energy recovery control switch Q3. The energy recovery control unit 345*c* forms a recovery path of the energy recovered from the address electrode X to the energy storing capacitor C. One terminal of the energy recovery control unit 345*c* is commonly connected to the energy storing capacitor C and the energy supply control unit 345*b*. It is preferable that the energy recovery control unit 345*c* further comprises a reverse blocking diode D4 for preventing an inverse current from flowing from the energy storing unit 345*a* to the energy recovery control switch Q3.

The inductor unit 345*d* supplies the energy stored in the energy storing unit 345*a* to the address electrode X through LC resonance. Further, the inductor unit 345*d* recovers the energy of the plasma display panel to the energy storing unit 345*a* through the LC resonance.

Figure 5:
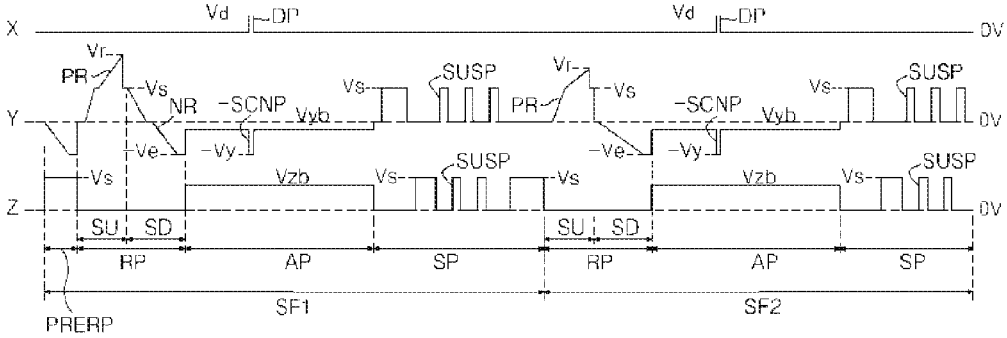
FIG. 5 illustrates a driving signal of the plasma display apparatus according to the embodiment of the present invention.

FIG. 5 illustrates a driving signal of the plasma display apparatus according to the embodiment of the present invention. As shown in FIG. 5, a first falling ramp signal which rises to a negative direction is supplied to the scan electrode Y and a positive voltage is supplied to the sustain electrode Z in a pre-reset period PRERP of a first subfield SF1. Further, after supplying a rising ramp signal PR, which rises to a positive direction, to the scan electrode Y in a setup period SU of a reset period RP, a second falling ramp signal NR which falls to a set-down reference voltage −Ve in a negative direction is supplied to the scan electrode Y in a set-down period SD of the reset period RP. A voltage of the sustain electrode Z is maintained at a reference voltage in the set-down period SD. It is preferable that the reference voltage is a ground level voltage. It is preferable that a voltage of the first falling ramp signal, as shown in FIG. 5, gradually falls. However, although a signal, which falls from a voltage of 0 V or a ground level voltage in a negative direction, is supplied irrespective of a shape of the signal, the effect of the pre-reset period is obtained. It is preferable that a slope of the positive voltage supplied to the sustain electrode Z, as shown in FIG. 5, is more than a slope of the first falling ramp signal. However, although a signal, which rises from a voltage of 0 V or a ground level voltage in a positive direction, is supplied irrespective of a shape of the signal, the effect of the pre-reset period is obtained.

In an address period AP, a scan signal −SCNP is supplied to the scan electrode Y, a data signal DP for rising to a data voltage Vd is supplied to the address electrode X, and a bias voltage vzb is supplied to the sustain electrode Z. The data signal DP is supplied through the data drive IC 341 of FIG. 4. The data drive IC 341 comprises an output terminal formed at one side and the other side of the data drive IC 341 which oppose to each other, and an input terminal formed at one side of the data drive IC 341.

The scan signal −SCNP falls to a scan voltage −Vy, and the scan voltage −Vy is −200 V. The bias voltage vzb is 100 V. By alternately supplying a sustain signal SUSP for rising to the sustain voltage Vs to the scan electrode Y and the sustain electrode Z in a sustain period SP, a sustain discharge is generated within the cell selected in the address period AP. It is preferable that the sustain signal is alternately supplied to the scan electrode Y and the sustain electrode Z. However, the sustain signal may be supplied to the scan electrode Y or the sustain electrode Z. In other words, a positive voltage and a negative voltage may be supplied to the scan electrode Y or the sustain electrode Z. The supply of the positive voltage and the negative voltage may repeat. At least one subfield of one frame comprises the pre-reset period. Preferably, the pre-reset period is included in a first subfield of one frame. This reason is that the initialization of the cells in the first subfield of one frame is relatively more difficult than the initialization of the cells in the remaining subfields except the first subfield of one frame. In other words, since the amount of space charges within the cells in the first subfield is relatively less than the amount of space charges within the cells in the remaining subfield, the initialization of the cells is difficult.

In the driving of the plasma display apparatus according to the embodiment of the present invention, an erasure discharge is not generated during the duration of time between the sustain period SP and the reset period SP. A set-down discharge and an address discharge are generated in the set-down period SD and the address period AP by using positive wall charges accumulated on the address electrode X by the sustain discharge generated in the previous subfield in all of the subfields. A voltage of the sustain electrode Z is maintained at the reference voltage GND or a voltage of 0 V during the set-down period SD. By using the positive wall charges accumulated on the address electrode X in the previous subfield, the set-down discharge and the address discharge are generated between the scan electrode Y and the address electrode X.

Since wall charges are sufficiently accumulated within each of the discharge cells before the setup period SD in the plasma display apparatus according to the embodiment of the present invention, a reset voltage Vr is lowered in the subfields except the first subfield SF1. For example, the reset voltage Vr is 100 V in the first subfield SF1, and the reset voltage Vr is 80 V in the subfields. In other words, the reset voltage Vr in the subfields except the first subfield SF1 may be less than the reset voltage Vr in the first subfield SF1. Further, the reset voltage Vr in the subfields except the first subfield SF1 may be omitted.

When the plasma display apparatus according to the embodiment of the present invention applies a driving signal with a waveform illustrated in FIG. 5, a delay value of the address discharge, that is, a jitter value is reduced as the plasma display apparatus go on the subsequent subfields.

Since positive wall charges and negative wall charges are sufficiently accumulated on the scan electrode Y and the sustain electrode Z within the cell in the pre-reset period in the plasma display apparatus according to the embodiment of the present invention, an erroneous discharge is prevented. Further, since a magnitude of the reset voltage Vr is small in the subfields except the first subfield SF1, darkroom contrast increases.

Figure 6:
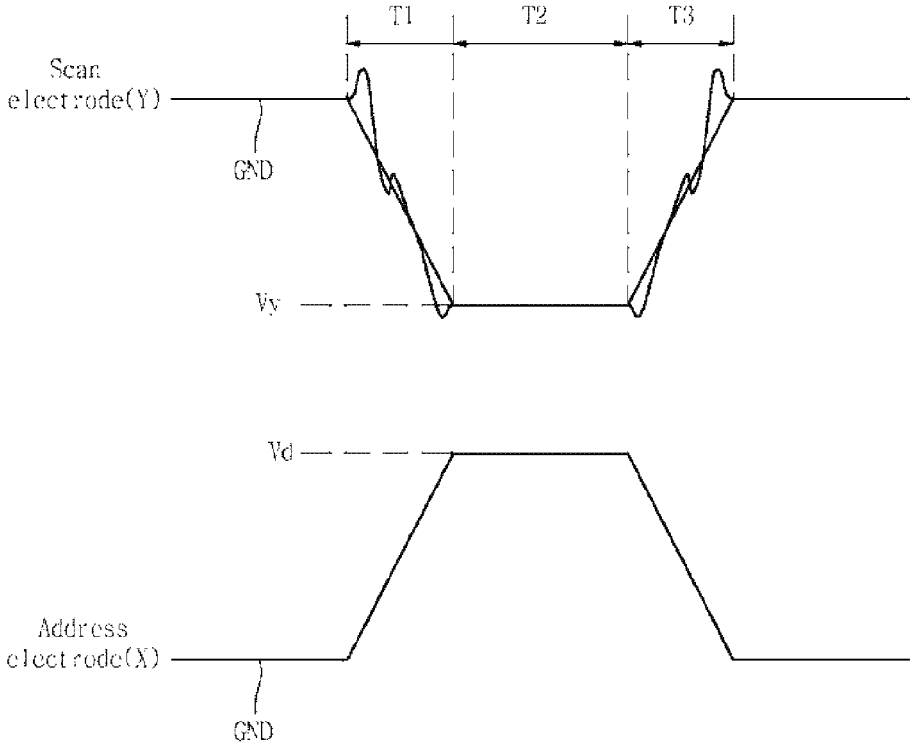
FIG. 6 illustrates a relationship between a scan signal and a data signal of the driving signal of the plasma display apparatus according to the embodiment of the present invention.

FIG. 6 illustrates a relationship between a scan signal and a data signal of the driving signal of the plasma display apparatus according to the embodiment of the present invention. In the address period, the data driver 340 of FIG. 3 supplies the data signal for selecting the cells to the address electrode, and the scan driver 320 supplies the scan signal to the san electrode. When the data driver 340 supplies the data signal shown in FIG. 6 through the data drive IC 341 of FIG. 4, the scan driver 320 supplies to the scan electrode a voltage which falls during a first time T1, the scan voltage −Vy maintained during a second time T2, and a voltage which rises during a third time T3 in named order. Since the duration of at least one of the first time T1 and the third time T3 ranges from 20 ns to 150 ns, a magnitude of a noise generated in the scan electrode decreases. The duration of the second time T2 may be changed in accordance with the order of the scan electrode to which the scan signal is supplied. For example, the duration of the second time T2 of a scan signal supplied to an n-th scan electrode may be different from the duration of the second time T2 of a scan signal supplied to an n+1-th scan electrode. When all of the scan electrodes are divided into two or more scan electrode groups, the duration of the first time T1 of the scan signal supplied to one or more scan electrode groups of all of the scan electrode groups may be different from the duration of the first time T1 of the scan signal supplied to the remaining scan electrode groups. Further, the duration of the third time T3 of the scan signal supplied to one or more scan electrode groups of all of the scan electrode groups may be different from the duration of the third time T3 of the scan signal supplied to the remaining scan electrode groups. The width of the scan signals supplied to the scan electrode in the address periods AP of the subfields SF1 and SF2 is equal to each other in FIG. 5. However, since the activity of space charges in the subfields which follow the first subfield SF1 is more than the activity of space charges in the first subfield SF1, the width of the scan signal in the subfields which follow the first subfield SF1 may be less than the width of the scan signal in the first subfield SF1.

The output terminal of the data drive IC 341 of FIG. 4 is formed at one side and the other side of the data drive IC 341, which oppose to each other, and the input terminal of the data drive IC 341 is formed at one side of the data drive IC 341.

Figure 7:
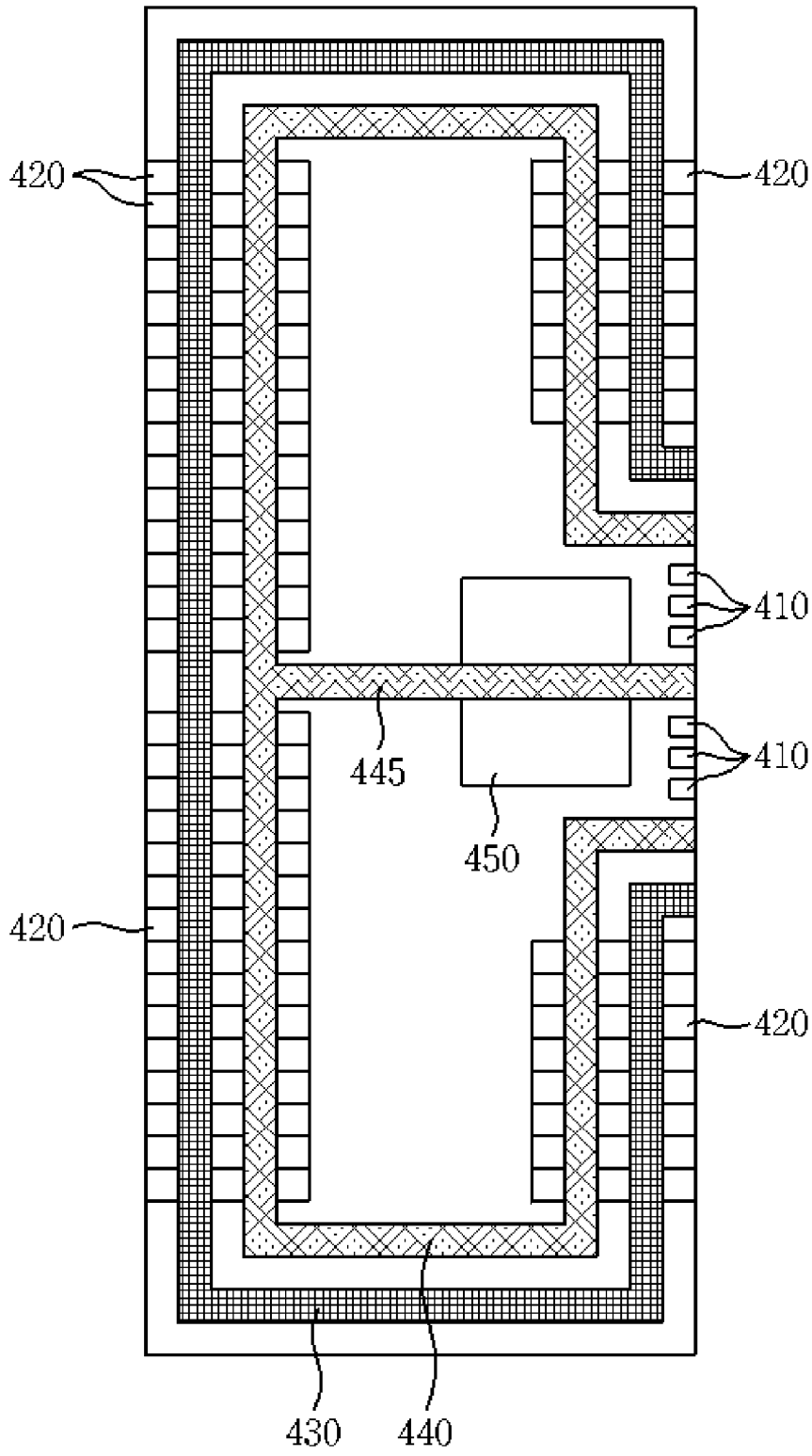
FIG. 7 illustrates a data drive IC of the plasma display apparatus according to the embodiment of the present invention.

FIG. 7 illustrates a data drive IC of the plasma display apparatus according to the embodiment of the present invention. As shown in FIG. 7, the data drive IC of the plasma display apparatus according to the embodiment of the present invention comprises an input terminal 410, a plurality of output terminals 420, a data voltage wiring unit 430, and a reference voltage wiring unit 440. The input terminal 410 is formed in the center of one side of the data drive IC and receives the image signal. The plurality of output terminals 420 are formed at one side and the other side of the data drive IC 341, which oppose to each other, and supply the data signal corresponding to the image signal to the address electrode. The data voltage wiring unit 430 receives the data voltage for generating the maximum voltage of the data signal. The reference voltage wiring unit 440 receives a reference voltage for generating a minimum voltage of the data signal.

The input terminal 410 of the data drive IC is substantially formed in the center of one side of the data drive IC. The output terminals 420 formed at one side of the data drive IC are formed at both sides of the input terminal 410. Since the input terminal 410 of the data drive IC is formed in the center of one side of the data drive IC, the connection of the data drive IC with the controller is easy.

The number of input terminals 410 of the data drive IC is 6 to 8, and the number of output terminals 420 is 96 to 256. The number of output terminals 420 formed at the other side of the data drive IC is three times the number of output terminals 420 formed at one side of the data drive IC. For example, when the total number of output terminals is 256, 192 output terminals are formed at the other side of the data drive IC, and 64 output terminals are formed at one side of the data drive IC.

Half the output terminals formed at one side of the data drive IC are formed at the right of the input terminal 410, and the remaining half are formed at the left of the input terminal 410. For example, when the total number of output terminals formed at one side of the data drive IC is 64, 32 output terminals are formed at the right of the input terminal 410, and 32 output terminals are formed at the left of the input terminal 410. The input terminal 410 of the data drive IC may be formed not only in the center of one side of the data drive IC but also on another portion of one side of the data drive IC.

Figure 8:
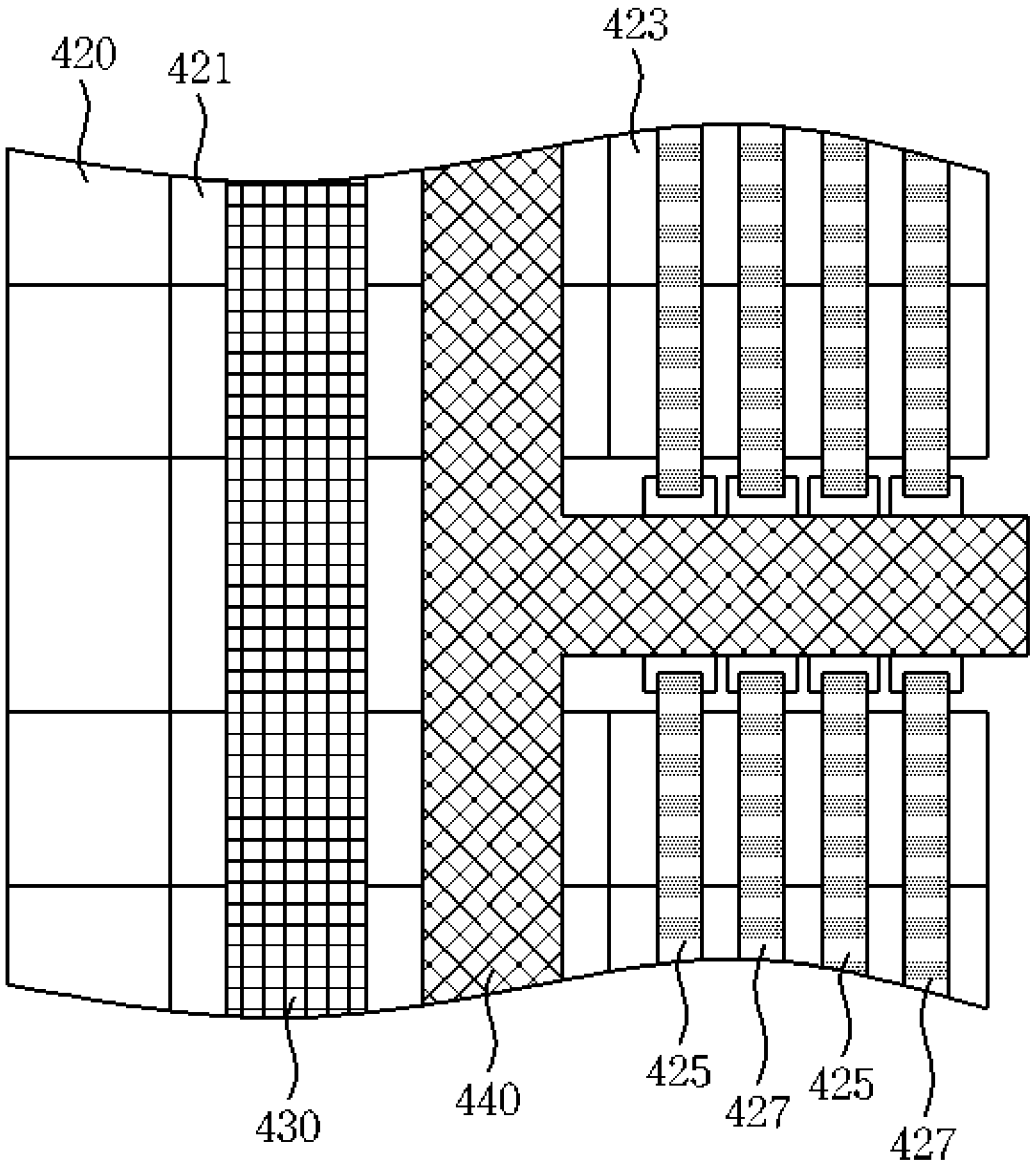
FIG. 8 is a partial enlarged view of the data drive IC of the plasma display apparatus according to the embodiment of the present invention.

FIG. 8 is a partial enlarged view of the data drive IC of the plasma display apparatus according to the embodiment of the present invention. As the output terminal 420 of the data drive IC, a high-voltage circuit 421 and a logical circuit 423, which output the data signal, are formed within the data drive IC of the plasma display apparatus according to the embodiment of the present invention. An auxiliary power supply unit 425 for supplying a power source to the logical circuit 423 and an auxiliary reference power supply unit 427 for supplying a reference voltage to the logical circuit 423 are formed on the logical circuit 423.

The logical circuit 423 is connected to the input terminal 410 and the output terminal 420 through an amplifier 450 of FIG. 7 and the high-voltage circuit 421 of FIG. 8. The data voltage wiring unit 430, the reference voltage wiring unit 440, the auxiliary power supply unit 425, and the auxiliary reference power supply unit 427 comprise a metal layer formed by molding performed by a patterning process, and are formed on the same layer. Thus, the manufacturing process of the data drive IC is simple and the manufacturing cost of the data drive IC decreases.

The data voltage wiring unit 430 and the reference voltage wiring unit 440 supply the data voltage and the reference voltage for generating the maximum voltage and the minimum voltage of the data signal, respectively. The amplifier 450 amplifies the image signal input through the input terminal 410.

The disposition of the terminals of the data drive IC is determined depending on the number of terminals including the input Terminal 410 and the output terminal 420, a distance between the terminals, and the flow of the signal inside the data drive IC. Further, the shorter a distance between one side and the other side of the data drive IC is, the smaller the size of the data drive IC is.

Figure 2:
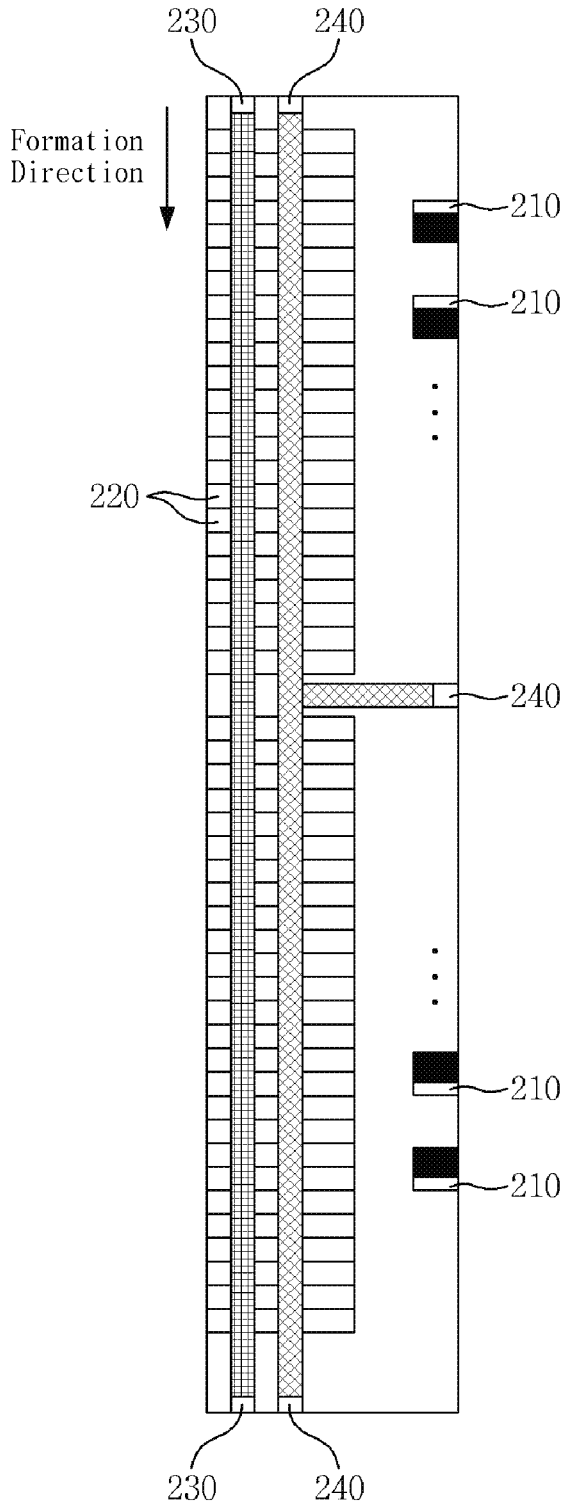
Fig. 2 Related Art
FIG. 2 illustrates a data drive integrated circuit (IC) of a plasma display apparatus.

In particular, since the output terminal 420 is formed at one side and the other side of the data drive IC, the size of the data drive IC is less than the size of the data drive IC of FIG. 2. It is preferable that the length of one side and the length of the other side of the data drive IC are equal to each other.

Figure 9:
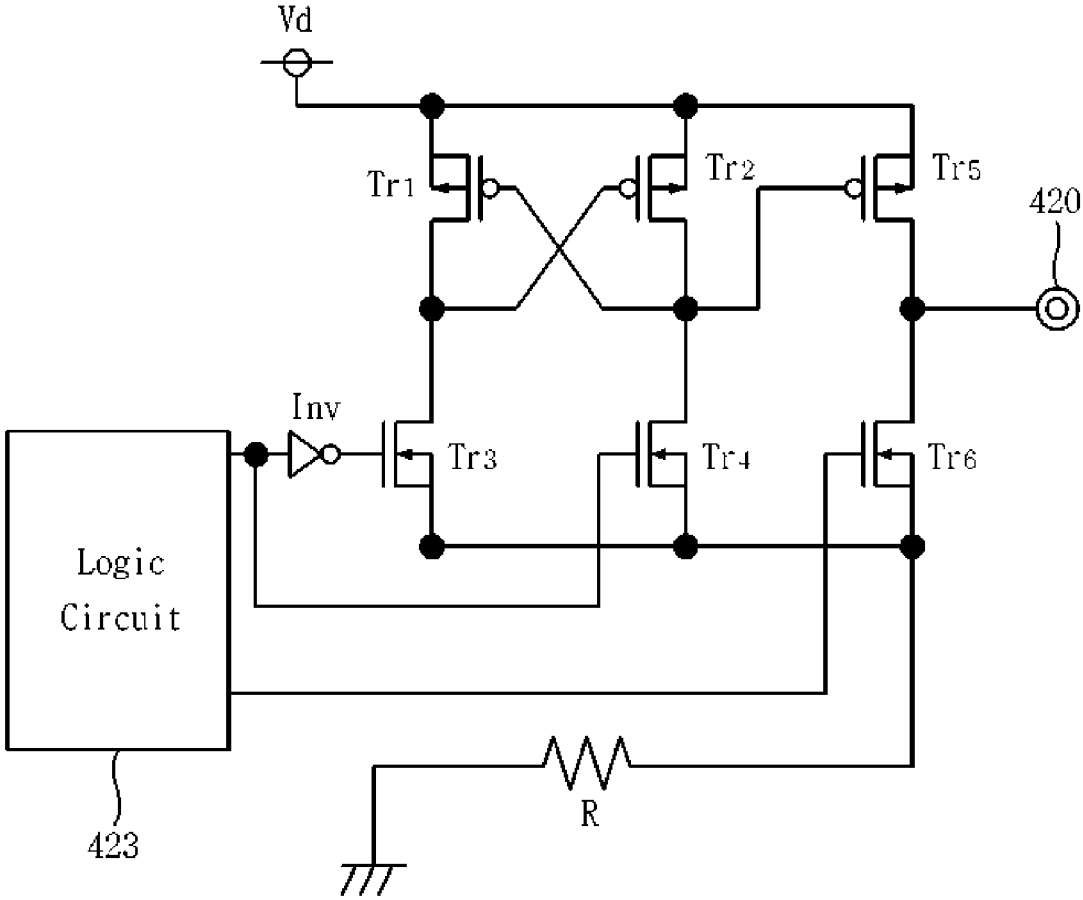
FIG. 9 illustrates a high-voltage circuit of the data drive IC of the plasma display apparatus according to the embodiment of the present invention.

FIG. 9 illustrates a high-voltage circuit of the data drive IC of the plasma display apparatus according to the embodiment of the present invention. As shown in FIG. 9, the high-voltage circuit of the data drive IC comprises first to sixth switching elements Tr1 to Tr6, an inverter Inv, and a resistance R. A signal output from the logical circuit 523 is supplied to a gate terminal of the fourth switching element Tr4. A signal reversed by the inverter Inv is supplied to a gate terminal of the third switching element Tr3. Thus, different signals are supplied to a gate terminal of the first switching element Tr1 and a gate terminal of the second switching element Tr2.

When the fifth switching element Tr5 or the sixth switching element Tr6 turns on by operations of the first to fourth switching elements Tr1 to Tr4, the remaining switching element Tr5 or Tr6 turns off. Thus, the data voltage Vd or the reference voltage is supplied to the output terminal 420 for outputting the data signal to one address electrode. The data voltage Vd is supplied through the data voltage wiring unit 430 of FIG. 7, and the reference voltage is supplied through the reference voltage wiring unit 440 of FIG. 7. In the data drive IC of the plasma display apparatus according to the embodiment of the present invention, the reference voltage is a ground level voltage, and the resistance R is a resistance of the reference voltage wiring unit 440.

The high-voltage circuit 421 of the data drive IC maintains the data signal at a particular voltage to prevent an erroneous operation of the data drive IC during a maintenance period of the data signal. For example, when the sixth switching element Tr6 turns on, the reference voltage of a ground level voltage is supplied to the output terminal 420 through the reference voltage wiring unit 440. Thus, the data signal is substantially maintained at a voltage of 0 V. That is, even when a surge current flows to the high-voltage circuit 421, a voltage of the output terminal 420 is maintained at a voltage of 0 V by a central wiring unit 445 being a part of the reference voltage wiring unit 440 of FIG. 7. Thus, there is a low likelihood that the data drive IC of the plasma display apparatus according to the embodiment of the present invention is erroneously operated by the surge current.

Figure 10:
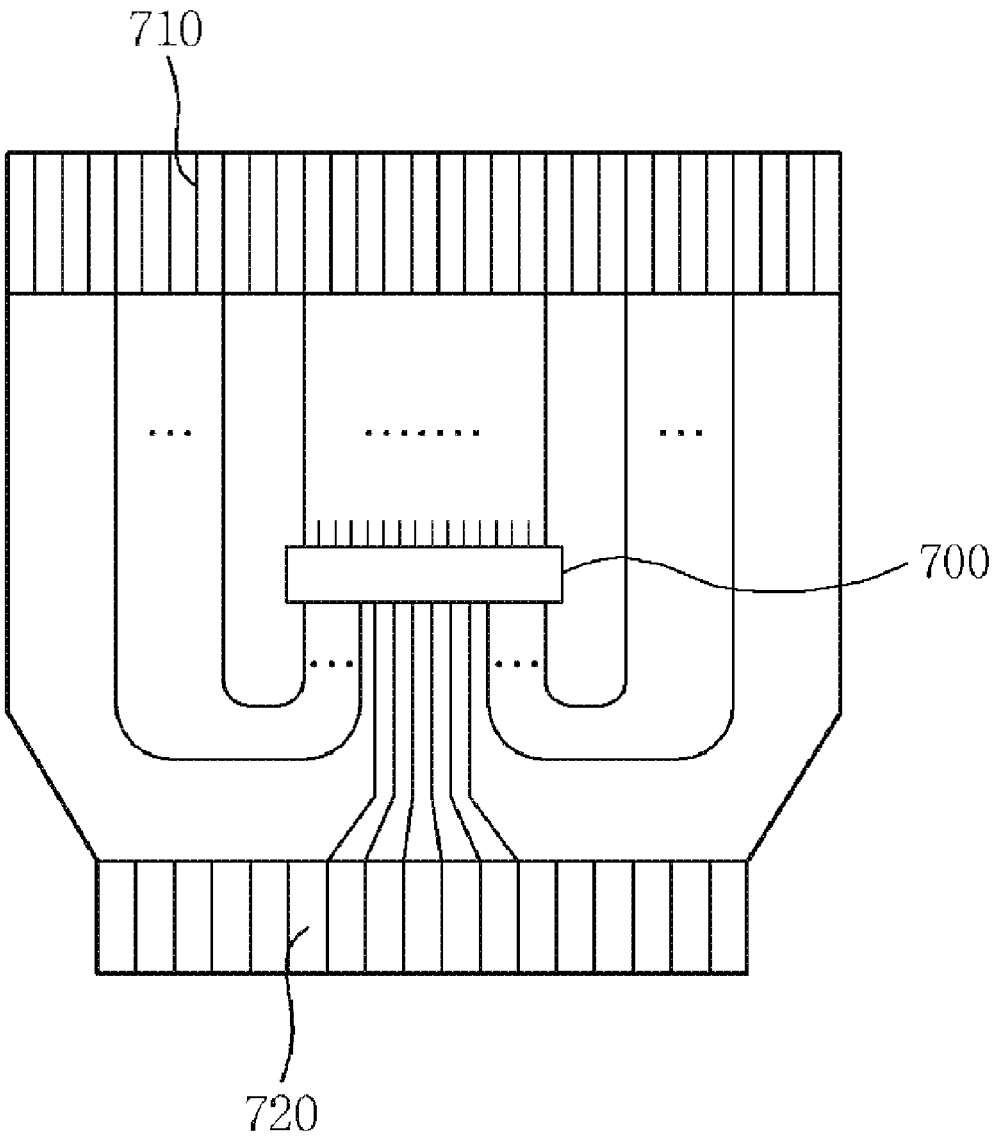
FIG. 10 illustrates a film type element equipped with the data drive IC of the plasma display apparatus according to the embodiment of the present invention.

FIG. 10 illustrates a film type element equipped with the data drive IC of the plasma display apparatus according to the embodiment of the present invention. The data drive IC of the plasma display apparatus according to the embodiment of the present invention is included in a film type element such as TCP or COF.

To prevent a damage of a data drive IC 700, a longitudinal direction of the data drive IC 700 is substantially parallel to a longitudinal direction of an electrode terminal 710 of the film type element. Further, the longitudinal direction of the data drive IC 700 is substantially perpendicular to a winding direction of the film type element. A formation direction of the electrode terminal 710 of the film type element is substantially parallel to the longitudinal direction of the data drive IC 700. In particular, an electrode terminal 720 of the film type element connected to the input terminal, the data voltage wiring unit, the reference voltage wiring unit of the data drive IC 700 is formed at one side of the film type element. Further, the electrode terminal 710 of the film type element connected to the output terminal of the data drive IC 700 is formed at the other side of the film type element opposing to one side of the film type element.

The above-described structure of the data drive IC prevents an unnecessary distance between amplifier circuits. In other words, since the amplifier circuits connected to the input terminal of the data drive IC are located closely to each other, the unnecessary distance between amplifier circuits is not generated. Thus, the size of the data drive IC decreases. The manufacturing cost of the data drive IC and the manufacturing cost of the plasma display apparatus decrease.

Further, since the reference voltage of the ground level voltage is supplied through three ends of the reference voltage wiring unit 440 including an end of the central wiring unit 445 of FIG. 7, a magnitude of the resistance R of FIG. 9 decreases. Thus, an erroneous operation of the plasma display apparatus caused by an erroneous operation of the data drive IC is prevented.

As shown in FIG. 7, the three ends of the reference voltage wiring unit 440 are formed at one side of the data drive IC, at which the input terminal 410 is formed. Thus, when the data drive IC is mounted on the film type element, a ground level voltage is supplied in the vicinity of the center of the reference voltage wiring unit 440 by the wiring of a single layer. Since the manufacturing method of the plasma display apparatus is simple, the manufacturing cost of the plasma display apparatus decreases.

The formation direction of the electrode terminals 710 and 720 of the film type element is substantially parallel to the longitudinal direction of the data drive IC. Thus, when the film type element is mounted on the plasma display apparatus, the length of the film type element in a winding direction thereof decreases. As a result, the manufacturing cost of the plasma display apparatus decrease.

Figure 11:
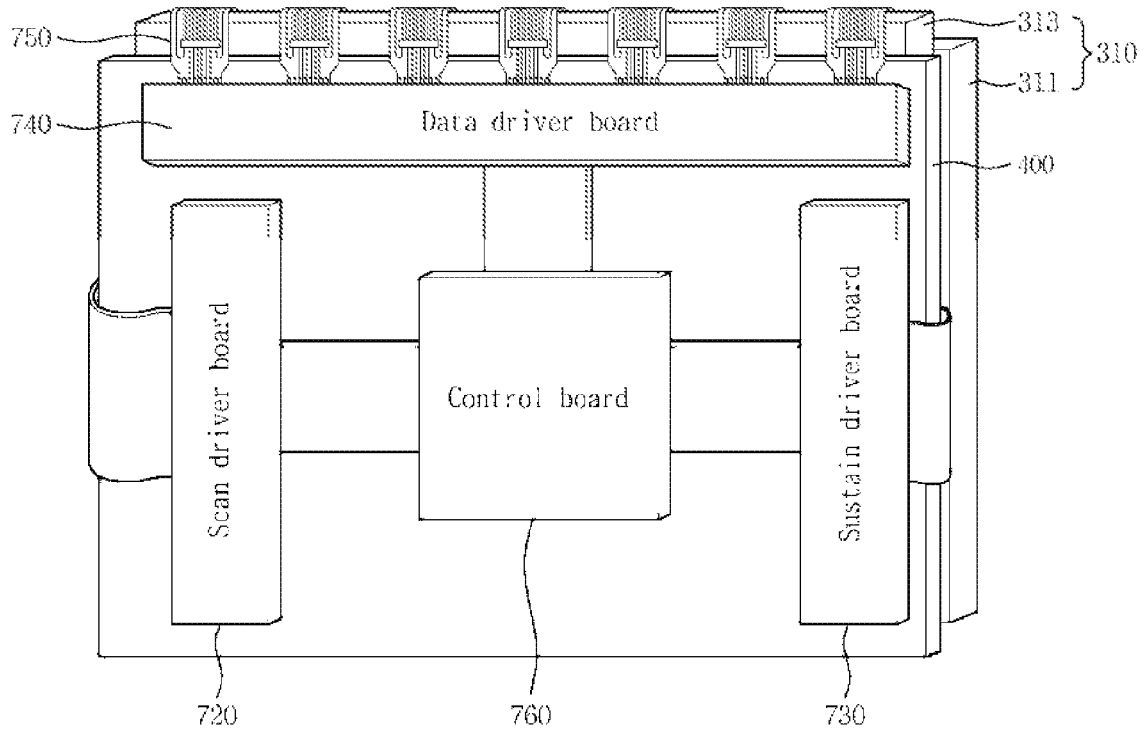
FIG. 11 illustrates the plasma display apparatus according to the embodiment of the present invention equipped with the film type element.

FIG. 11 illustrates the plasma display apparatus according to the embodiment of the present invention equipped with the film type element. As shown in FIG. 11, a heat dissipation plate 400 for the heat emission is formed on a plasma display panel 310 including a front panel 311 and a rear panel 313. A scan driver board 720 and a sustain driver board 730, on which the scan driver 320 and the sustain driver 330 of FIG. 3 are formed, are disposed on the heat dissipation plate 400.

Further, a film type element 750 and a data driver board 740, on which the data driver 340 of FIG. 3 is formed, are disposed on the heat dissipation plate 400. The data driver board 740 receives the image signal from a control board 760, transmits the image signal to the film type element 750, and generates the data voltage. The film type element 750 equipped with the data drive IC receives the image signal from the control board 760, and then supplies the data signal corresponding to the image signal to the address electrode formed on the rear panel 313. At this time, since the output terminal of the data drive IC is formed at one side and the other side of the data drive IC, which oppose to each other, the size of the data drive IC and the size of the film type element decrease.

The embodiment of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel comprising an electrode; and a data drive integrated circuit (IC) for supplying a data signal corresponding to an image signal to the electrode through an output terminal formed at one side and the other side of the data drive IC which oppose to each other.

2. The plasma display apparatus of claim 1, wherein the electrode comprises an address electrode.

3. The plasma display apparatus of claim 1, wherein an input terminal of the data drive IC for receiving the image signal is formed at one side of the data drive IC.

4. The plasma display apparatus of claim 3, wherein the input terminal is substantially formed in the center of one side of the data drive IC, and wherein a part of the output terminal formed at one side of the data drive IC is formed at the left of the input terminal formed in the center of one side of the data drive IC, and the remaining part of the output terminal formed at one side of the data drive IC is formed at the right of the input terminal formed in the center of one side of the data drive IC.

5. The plasma display apparatus of claim 1, wherein the data drive IC comprises an input terminal, which receives the image signal and is formed at one side of the data drive IC, a data voltage wiring unit for receiving a data voltage of the data signal, and a reference voltage wiring unit for receiving a reference voltage of the data signal.

6. The plasma display apparatus of claim 5, wherein the reference voltage wiring unit comprises two or more ends, and wherein at least one of the two or more ends is formed at one side of the data drive IC.

7. The plasma display apparatus of claim 5, wherein the reference voltage is a ground level voltage.

8. The plasma display apparatus of claim 1, wherein the data drive IC is mounted on a film type element.

9. The plasma display apparatus of claim 8, wherein a direction of an electrode terminal of the film type element is substantially parallel to a longitudinal direction of the data drive IC.

10. The plasma display apparatus of claim 1, wherein the data drive IC comprises a high-voltage circuit for outputting the data signal to the output terminal of the data drive IC, a logical circuit for controlling the high-voltage circuit, an auxiliary power supply unit for supplying a power source to the logical circuit, an auxiliary reference power supply unit for supplying a reference voltage to the logical circuit, a data voltage wiring unit for supplying a data voltage of the data signal to the high-voltage circuit, and a reference voltage wiring unit for supplying a reference voltage to the high-voltage circuit, wherein the auxiliary power supply unit, the auxiliary reference power supply unit, the data voltage wiring unit, and the reference voltage wiring unit are formed on the same layer.

11. The plasma display apparatus of claim 10, wherein the auxiliary power supply unit, the auxiliary reference power supply unit, the data voltage wiring unit, and the reference voltage wiring unit comprise a metal layer.

12. A plasma display apparatus comprising:

a plasma display panel comprising a scan electrode, a sustain electrode and an address electrode;

a scan driver for driving the scan electrode;

a sustain driver for driving the sustain electrode; and a data drive IC for supplying a data signal corresponding to an image signal to the address electrode through an output terminal formed at one side and the other side of the data drive IC which oppose to each other.

13. The plasma display apparatus of claim 12, wherein an input terminal of the data drive IC for receiving the image signal is formed at one side of the data drive IC.

14. The plasma display apparatus of claim 13, wherein the input terminal is substantially formed in the center of one side of the data drive IC, and wherein a part of the output terminal formed at one side of the data drive IC is formed at the left of the input terminal formed in the center of one side of the data drive IC, and the remaining part of the output terminal formed at one side of the data drive IC is formed at the right of the input terminal formed in the center of one side of the data drive IC.

15. The plasma display apparatus of claim 12, wherein the data drive IC is mounted on a film type element.

16. A plasma display apparatus comprising:

a plasma display panel comprising a scan electrode, a sustain electrode and an address electrode;

a scan driver for supplying a first signal, which rises to a negative direction, in a pre-reset period, after supplying a second signal which rises to a positive direction, for supplying a third signal, which rises to a negative direction, in a reset period, and for supplying a scan signal in an address period, to the scan electrode;

a sustain driver for supplying a fourth signal, which rises to a positive direction, to the sustain electrode in the pre-reset period; and a data drive IC for supplying a data signal corresponding to an image signal to the address electrode through an output terminal formed at one side and the other side of the data drive IC, which oppose to each other, during the supply of the scan signal to the scan electrode.

17. The plasma display apparatus of claim 16, wherein the pre-reset period is included in a first subfield of all of subfields.

18. The plasma display apparatus of claim 17, wherein a magnitude of a maximum voltage of a rising ramp signal supplied in the first subfield is more than a magnitude of a maximum voltage of a rising ramp signal supplied in a subfield which follows the first subfield.

19. The plasma display apparatus of claim 16, wherein when supplying the third signal, the sustain driver supplies a reference voltage to the sustain electrode.

20. The plasma display apparatus of claim 16, wherein the output terminal of the data drive IC supplies the data signal formed by resonance to the address electrode.

* * * * *